US005126623A

United States Patent [19]

Choi

[11] Patent Number: 5,126,623

[45] Date of Patent: Jun. 30, 1992

[54] DISPENSER CATHODE

[75] Inventor: Jong-seo Choi, Ansan, Rep. of Korea

[73] Assignee: Samsung Electronics Co,. Ltd., Kyunggi, Rep. of Korea

[21] Appl. No.: 636,442

[22] Filed: Dec. 31, 1990

[30] Foreign Application Priority Data

Dec. 30, 1989 [KR] Rep. of Korea ..... 89-20792

[51] Int. Cl.[5] ..... H01J 19/06

[52] U.S. Cl. ..... 313/346 DC

[58] Field of Search ..... 313/346 R, 346 DC; 445/50, 51; 447/34; 427/77

[56] References Cited

U.S. PATENT DOCUMENTS 4,810,926 3/1989 Schwarz et al. ..... 313/346 DC
4,976,644 12/1990 Jung ..... 445/50
4,982,133 1/1991 Choi ..... 313/346 DC

*Primary Examiner*—Donald J. Yusko
*Assistant Examiner*—Diab Hamadi
*Attorney, Agent, or Firm*—Cushman, Darby & Cushman

[57] ABSTRACT

A dispenser cathode comprises an electron emissive materials, a porous base body containing tungsten, a reservoir storing the porous base body, and a sleeve storing the heater therein. The porous base body contains $TiO_2$ or $ZrO_2$. The dispenser cathode achieves high luminance and high definiteness required by a large-sized display and the time for manufacturing the cathode is reduced.

2 Claims, 1 Drawing Sheet

DISPENSER CATHODE

FIELD OF THE INVENTION

The present invention relates to a dispenser cathode for use in an electron tube such as cathode ray tube, and particularly to an improved dispenser cathode which has a high current density and a long lifetime under low temperature operation.

BACKGROUND OF THE INVENTION

Recently, as the electron tubes such as projection tube, HDTV and projection television tend to become larger, new type of cathodes are to be adapted to such an electron tube are demanded. The cathodes suitable to this demand should include a dispense cathode having a higher current density than that of oxide cathode and having a longer lifetime, for which steady research and development have been carried out. These dispenser cathodes are divided into an impreganated type and a cavity reservoir type. However, these dispenser cathodes have an operating temperature of 900° to 1100° C. which is about 200° C. higher than that of a conventional oxide cathodes. Such a high operating temperature requires the cathode to adopt heater having a large calorimeter, so that the cathode itself and other parts neighboring thereto should be made of a heat-resistant material. Further, a higher operating temperature increases the amount of Ba (or BaO) evaporated from the cathode. So Ba evaporated is attached to the neighboring parts, especially attached to a control grid positioned adjacently to the cathode, so that a second emission, so called a grid emission, damaging the cathode is generated. The cathode improving the defect which is caused by a higher operating temperature of this cathode include "M-type" dispenser cathode disclosed in U.S. Pat. No. 3,373,307 and "Sc-type" impregnated cathode disclosed in U.S. Pat. No. 4,737,639.

"M-type" dispenser cathode comprises a porous tungsten base body coated with a platinum group element such as Os, Ir, Re. Ru having a work function higher than that of tungsten in which, Ba concentration on the cathode surface is enhanced due to the material coated on the surface of the tungsten base body, thereby reducing a work function.

In "Sc type" dispenser cathode, a layer containing Sc is coated on the surface of the porous base body in order to reduce the operating temperature. However, these dispenser cathodes have an operating temperature of about 100° to 200° C. higher than that of the conventional oxide cathode, therefore there are problems of the selection of the material as described above, of the short lifetime by the evaporation of thermoelectron emission material, and of long time required in aging.

THE SUMMARY OF THE INVENTION

The object of the present invention is to provide the dispenser cathode which can operate under a low temperature to lengthen the lifetime, and steadily emit stable thermoelectron.

To accomplish the above object, the dispenser cathode according to the present invention comprises an electron emissive material, a porous base body containing tungsten and a reservoir for storing the porous base body, wherein said porous base body includes $TiO_2$ and or $ZrO_2$ and a metal thin layer made of at least one element selected from the group consisting of Os, Ir, Re and Ru is formed on the upper surface of the porous base body.

The present invention has the reduction effect of a work function by $TiO_2$ or $ZrO_2$ contained in said porous base body and thus can be applied to either an impregnated type cathode or a reservoir type cathode. Especially, the dispenser cathode of the present invention in which the coating layer made of the element of the aforesaid platinum group is formed on the surface of said porous base body has a high current density at the operating temperature slightly higher than that of oxide cathode.

BRIEF DESCRIPTION OF THE DRAWINGS

The above object and other advantages of the present invention will become more apparent by describing the preferred embodiments of the present invention with reference to the attached drawing, in which.

DETAILED DESCRIPTION OF EXAMPLE

Figure 1:
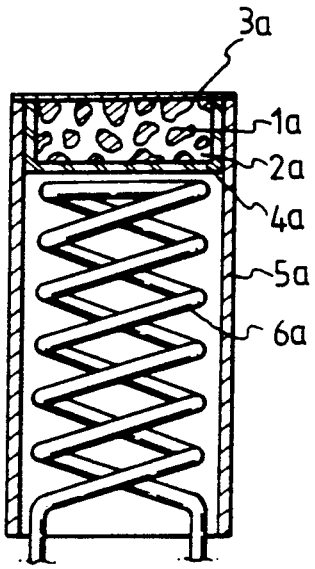
FIG. 1 illustrates a cross-sectional view of an embodiment of the dispenser cathode according to the present invention.

As shown in FIG. 1, the impregnated type dispenser cathode of the present invention has a reservoir 4*a*, a porous base body 1*a* into which an electron emissive material 2*a* impregnated and on the surface of which a metal thin film layer 3*a* is formed, and a sleeve 5*a* supporting and fixing said reservoir 4*a* and storing the heater 6*a* therein. And said metal thin film layer 3*a* is made of at least one element selected from the platinum group consisting of Os, Ir, Re and Ru. One of distinctive features of the present invention resides in that the porous base body 1*a* is mainly made of tungsten as a heat-resistant metal and further contains a proper amount of $TiO_2$.

The dispenser cathode according to the present invention is prepared by the following method.

Pure tungsten powder having a particle diameter of 3 to 8 μm and $TiO_2$ of the amount equivalent to 10 to 50 wt % of pure tungsten powder is sufficiently mixed to prepare the mixed powder. The mixed powder is then pressed-molded into a bar of a certain length by conventional method. And then, this pressed-molded bar is sintered at a temperature of 1500° to 2000° C. under a vacuum or a hydrogen atmosphere to prepare a solidified pressed-mold having a porosity of 15 to 40%. Here, the difference of melting points between W and $TiO_2$ is great and their sintering temperature is high so that a trace of nickel is added as a sintering assistant agent when they are sintered. Said press-mold sintered by this step is cut into a desired size to prepare unit porous base body. The cathode material is impregnated into said porous base body by the ordinary method and the metal selected from the elements of the platinum group is coated on the surface of the porous base body to form the coating layer.

In the dispenser cathode of the present invention, when free Ba (or BaO) obtained from the reduction reaction of an electron emissive material with tungsten, is diffused into the surface of the coating layer made of the element of the platinum group, the molecule (such as $BaTiO_3$) having a stable structure is formed by BaO and $TiO_2$ contained in the porous base body. Therefore the bonding force of Ba or BaO diffused into the surface of the coating layer by said molecule increases and therefore their concentration increase greatly as compared with those of the conventional cathode. Thus, thermoelectron is released even under low temperature.

The impregnated type cathode according to the present invention was aged for about 1 hour and then the current density thereof is measured to be, at the operating temperature of 750° to 800° C., greater than 5 $A/cm^2$ which is required for the cathode.

Figure 2:
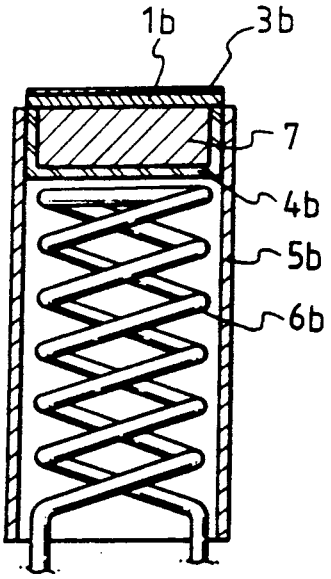
FIG. 2 illustrates a cross-sectional view of another embodiment of the dispenser cathode according to the present invention.

FIG. 2 shows the second example of the cavity dispenser cathode according to the present invention.

This cathode has a reservoir 4*b*, a sleeve 5*b* supporting and fixing said reservoir 4*b* and enclosing the heater 6*b*, a press-mold 7 made of barium calcium Aluminate as an electron emissive material and tungsten(W) is contained in the reservoir 4*b* and the porous base body 1*b* made of $TiO_2$ and tungsten is positioned on the press-mold 7, in which the method for preparing a porous base body is the same as that of the first example, except that the cathode material is not impregnated into porous base body. The surface of the porous base body 1*b* is covered with the coating layer 3*b* made of the element of the platinum group.

The cavity dispenser cathode according to the present invention has the same effect as that of said first example.

That is, when free Ba (or BaO) is produced from said cathode material heated by the heater and is diffused towards the surface of the coating layer 3*b*, Ba (or BaO) concentration at the surface of the coating layer increases and the work function is lowered via the same operation principle as in example 1 and therefore, the same electron emission capability as in example 1 is obtained.

According to the experiments, the cathode of example 2 is activated within short time as compared with the conventional dispenser cathode. The cavity dispenser cathode obtained from example 2 and the impregnated dispenser cathode obtained from example 1 were turned out to be similar to each other in the operation temperature or in the current density. However, due to the difference in structures of two, the activation time of example 1 were longer by 1 to 1.5 hour than that of example 2.

The dispenser cathode according to the present invention is prepared by using tungsten and $TiO_2$ as the principal ingredient of the porous base body, in which $TiO_2$ may be replaced by $ZrO_2$ of the same weight %, realizing similar performance.

Therefore, differing from the conventional dispenser cathode having the current density of about 4 $A/cm^2$ at a temperature of 950° to 1200° C., the dispenser cathode according to the present invention has a high current density of 5 $A/cm^2$ at the operation temperature of 750° to 850° C. which is a little higher than that of the conventional oxide cathode. In the dispenser cathode of the present invention, the thermal deformation of the cathode components reduces greatly because the operation temperature is low, and the lifetime lengthens as the calorific value of the heater decreases.

As described above, the dispenser cathode according to the present invention has the porous metal base body having a high melting point which has tungsten and titanium oxide ($TiO_2$) as the principal ingredient, and can achieve high luminance and high definiteness required by a large-sized display. And the time for manufacturing the cathode is reduced by reducing the activation time, improving productivity.

What is claimed is:

1. A dispenser cathode comprising an electron emissive material, a porous base body containing tungsten, a reservoir storing the porous base body, and a sleeve supporting the reservoir and storing a heater therein, wherein said porous base body contains, throughout said porous base body, at least one material selected from the group consisting of $TiO_2$ and $ZrO_2$, the amount of said $TiO_2$ or $ZrO_2$ being 10 to 50 wt % per the weight of tungsten.

2. The dispenser cathode as claimed in claim 1, wherein the surface of said porous base body is covered with a metal thin film layer made of at least one element selected from the group consisting of Os, Ir, Re and Ru.

* * * * *